US005297487A

United States Patent [19]

Simmons

[11] Patent Number: 5,297,487

[45] Date of Patent: * Mar. 29, 1994

[54] INK CONTAINMENT APPARATUS FOR SCREEN PRINTING FRAME ASSEMBLIES

[76] Inventor: David O. Simmons, 16609 Black Kettle Dr., Leander, Tex. 78641

[ * ] Notice: The portion of the term of this patent subsequent to Aug. 11, 2009 has been disclaimed.

[21] Appl. No.: 16,505

[22] Filed: Feb. 11, 1993

[51] Int. Cl.[5] ..... B05C 17/06

[52] U.S. Cl. ..... 101/127; 101/128.1; 118/504

[58] Field of Search ..... 101/127-128.4; 118/504, 505

[56] References Cited

U.S. PATENT DOCUMENTS

| | | | |
|---|---|---|---|
| 4,023,488 | 5/1977 | Zimmer | 101/127.1 |
| 4,520,727 | 6/1985 | Miller | 101/127 |
| 5,136,939 | 8/1992 | Simmons | 101/128.1 |
| 5,148,745 | 9/1992 | Hamu | 101/127.1 |

FOREIGN PATENT DOCUMENTS

| | | | |
|---|---|---|---|
| 8403662 | 9/1984 | PCT Int'l Appl. | 101/127.1 |

*Primary Examiner*—Edgar S. Burr
*Assistant Examiner*—Ren Yan

[57] ABSTRACT

An apparatus that contains inks and other substances of similar viscous within the usable area of a screen printing frames assembly. A structural assembly defining the enclosed area in which the ink is to be contained fits within the perimeter of the frame. Incorporated into the structural assembly is a resilient sealing edge which ensures that the ink is contained within the area defined by the apparatus. Furthermore, a substantially rigid retaining mechanism is incorporated into the apparatus for positive assurance that the position of the apparatus relative to the screen printing frame assembly is maintained constant. In a preferred embodiment, the retaining mechanism consists of a series of rigid retaining arms which are secured to the frame using threaded fasteners.

19 Claims, 6 Drawing Sheets

FIGURE 3
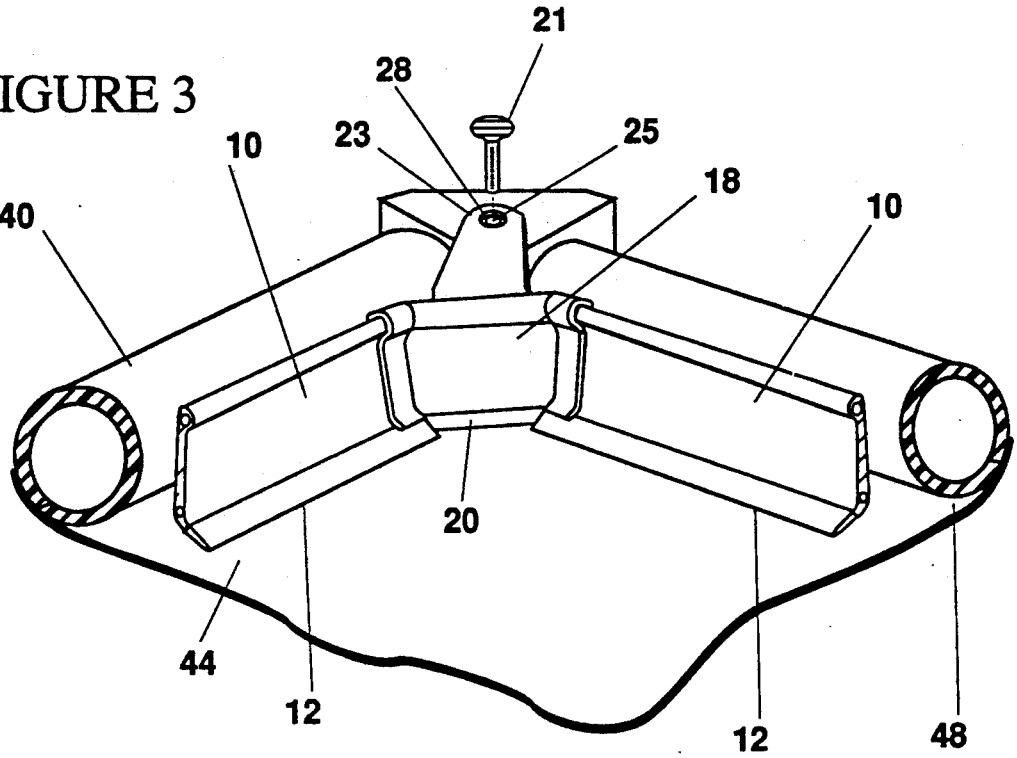
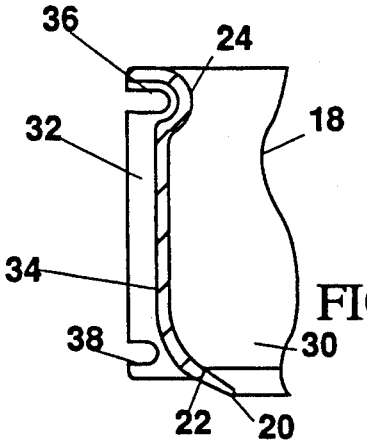
FIGURE 4
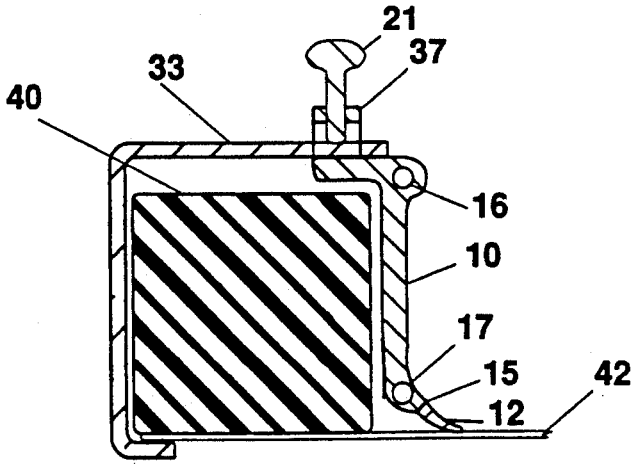
FIGURE 5

INK CONTAINMENT APPARATUS FOR SCREEN PRINTING FRAME ASSEMBLIES

BACKGROUND OF THE INVENTION

1. Field of the Invention

This invention relates to screen printing apparatus. Specifically, to such apparatus which is used for containing inks and other substances of similar viscosity within the usable area of screen printing frame assemblies, and which utilize a substantially rigid retaining mechanism to secure the apparatus to the screen printing frame.

2. Description of the Prior Art

The screen printing process involves a number of essential set-up procedures. For example, setting up a simple one-color design would include the following:

1. Creating a stencil of the imprinted image on the screen,
2. Securing the screen to a printing press,
3. Registering the stencil in relation to the substrate being printed, and
4. "Taping-off" the interior perimeter of the frame.

To create the stencil, a screen is coated with a photosensitive emulsion and allowed to dry. Once the emulsion has dried, a film positive (reverse of film negative) of the image to be imprinted is placed in intimate contact with the screen, and exposed to light in the UV spectrum. The photosensitive emulsion under the open areas of the film positive cures while the emulsion under the darkened areas of the film positive does not. The uncured emulsion is then washed from the screen using water under high pressure and the screen is allowed to dry. The resulting pattern on the screen is a stencil of the image that will be printed. The screen printing frame assembly (frame and screen) is then attached to a printing press, and aligned such that the imprinted image is printed in the desired location and orientation on the underlying substrate. Following registration, the inside perimeter of the frame is "taped-off".

Taping-off the screen consists of applying pieces of tape around the inside perimeter of the frame. The purpose of applying the tape is to seal off the interface where the screen meets the frame preventing ink from flowing out of the usable area of the screen, and correspondingly into the gap between the frame and the screen. And, since the emulsion is typically coated ½" to 1" from the edge of the screen, taping-off the screen prevents ink from flowing through the screen at any open areas around the edge of the screen where emulsion was not coated.

Failure to tape-off screens or properly tape-off screens results in the following adverse condition arising.

1. Misprints due to ink passing through the screen at unintended locations.
2. Excessive ink consumption due to ink flowing out of the usable area of the screen, and correspondingly into the gap between the screen and the frame.
3. Excessive clean-up time since ink between the screen and the frame must be flushed out using solvents.

As the term "taping-off" implies, tapes exclusively are presently being used for this application. From the multitude of tapes that are currently available, only those displaying the following characteristics are generally used for this application.

1. High Flexibility-the screen stretches during printing

2. Solvent Resistant-during printing, the adhesive and the backing are exposed to solvents in the ink
3. High Tack Adhesive-the tapes must not release from the screen during potentially long print runs.
4. Integral Construction-the adhesive must remain with the backing when removed from the screen.
5. Inexpensive-the tape must be reasonably priced since a considerable amount of tape is used on each frame and thrown away after printing is completed.

In response to the above requirements, tapes have been developed specifically for this screen printing application. The majority of these tapes are improved versions of existing tapes which provide superior solvent resistance. Tapes termed "split linered" have been developed specifically for taping-off screen printing frames. These tapes get their name from having a removable liner on the adhesive side that has been die cut down the center of the tape width. Corresponding to the line where the liner is die cut, a crease is created in the tape backing thereby providing a fold line. The convenience of this tape is that it allows the printer to neatly and accurately affix the tape to the frame and the screen by removing one liner, positioning and affixing the tape to the screen, and then removing the other liner and affixing the other half of the tape to the frame.

While most printers use generic packaging tapes or solvent resistant tapes, use of split linered tapes is common by large volume printers since their print runs are longer, and they often have the occasion to print the same design several times before making a new stencil. As a result of the special nature of these split linered tapes, their cost is significantly higher than generic packaging tapes or solvent resistant tapes. Whereas a standard clear plastic packaging tape or solvent resistant tape cost approximately $3.00–$4.00 a roll, split linered tape can be as much as 4 times more for the same size roll.

Although printers are currently using a number of different types of tapes to tape-off their screens, perceiving them to be convenient because they are available through numerous sources and perform the task at hand, all tapes suffer from a number of disadvantages when used in this capacity:

1. Hazardous to the environment because they are used as a disposable product but are not biodegradable or recyclable. Not only are the tapes not biodegradable or recyclable, but neither is the ink which is on the tape when it is removed from the screen and discarded. In actuality, the inks disposed of with these tapes pose a special concern because some of them contain hazardous chemicals, and if incinerated, can form other hazardous/toxic compounds.
2. Costly due to depletion and the overhead associated with installing/removing the tape to/from the screen. When used disposably, even the most economically priced tapes contribute significantly to overhead. Equally critical is the overhead associated with installing and removing these tapes to/from the screens since the competitiveness of most printers is directly related to minimizing set-up time and maximizing run time.
3. Difficult to handle during installation and messy to handle when removing from the screen. The high tack adhesive makes the tape difficult to handle during application since it tends to aggressively stick to anything it touches. And when it is removed from the screen after printing, the printer has to contend with not only the tacky adhesive, but also with the tape being covered with ink.

4. Unsatisfactory performance over extended periods of exposure to solvent/inks. Regardless of the tape being used, over extended periods of time, the solvents in the inks will attack the adhesive on the tape and reduce their adhesion.

SUMMARY OF THE INVENTION

A perspective drawing showing the invention (referred to hereafter as apparatus) as installed in a screen printing frame assembly is shown in FIG. 2. As most screen printing frame assemblies are rectangular in shape, four linear members 10 connected end to end with four unions 18 comprise the apparatus shown. As shown, each union 18 includes a retaining arm 23 for the purpose of securing the apparatus to frame 40. The apparatus is installed by placing it within frame 40, inserting retaining screws 21 through holes 28 in retaining arms 23, and fastening retaining screws 21 into retaining screw holes 25. The lip 20 of each union 18 and the sealing flap 12 of each linear member 10 interfaces with screen 42 providing boundary 44 which contains ink and other substances of similar viscosity within the area defined by the apparatus.

A retaining system, as shown in FIG. 5, which utilizes a set of brackets 33 and bracket clamps 37 can also be used to mount the apparatus to frame 40. The apparatus is placed within frame 40, brackets 33 are inserted into bracket clamps 37 such that they engage the bottom surface of frame 40, and then, retaining screws 21 are fastened to secure brackets 33.

FIGS. 6 and 7 show an embodiment of the invention in which the apparatus is secured to frame 40 by latches 27 which engage under ledges 29. The apparatus is placed within the frame and each latch 27 is engaged with the corresponding ledge 29.

In applications where it is most convenient to use the frame mounting mechanism of printing press 54 to secure the apparatus to frame 40 an apparatus according to the embodiment shown in FIGS. 12 and 13 is preferable. As shown in FIG. 12, clamping flange 49 is provided along linear members 10 such that frame clamping screws 52 secures the apparatus to frame 40, and subsequently, frame 40 to printing press 54. FIG. 13 shows the addition of arched surface 56 such that the apparatus can be used with roller-type frames. Arched surface 56 acts as an adapter which provides a flat surface for applying a clamping force with frame clamping screws 52 or similar device.

Accordingly, the invention described has the following advantages:

1. Environmentally safer than tapes because the invention is a durable product, designed for long-lasting use. Unlike tapes, this invention is a non-disposable product that will be used as a tool rather than a disposable supply item. Therefore, the ecological hazards associated with throwing away ink covered tapes will not be experienced. Although the apparatus requires cleaning, it can be cleaned in the same solvent baths that the printers are currently using to clean their squeegees and other tools.

2. Less costly method of "taping-off" screens than tapes since it is a durable, non-disposable product. The materials comprising the components of the apparatus are essentially unaffected by the solvents found in printing inks, and the solvents that printers use to clean their equipment.

3. Less costly because the installation and removal time is a fraction of that required for tapes. Installation consists of simply placing the apparatus within the frame and fastening in place with the retaining mechanisms. Removal is facilitated by simply disengaging the retaining mechanisms and removing the apparatus. This also adds convenient since it can be installed quickly and easily before or after the frame is secured to the press.

4. Requires no maintenance other than an occasional cleaning when changing print colors or when excess ink build-up is experienced.

5. No special skills or training is required since the operation of the apparatus is relatively simple. The printers will be able to implement the apparatus into their current operation without any significant effort.

6. Less messy than tapes, since installing and removing the apparatus does not require the printer to come into contact with any ink that may be on it. Under normal conditions, only a limited portion of the apparatus will come into direct contact with the ink, and the printer is not required to handle this area during installation or removal.

Further objects and advantages of my invention will become apparent from a consideration of the ensuing drawings and descriptions of them.

BRIEF DESCRIPTION OF THE DRAWINGS

FIG. 3 is a perspective view showing retaining arm 23 incorporated into each union 18.

FIG. 4 is an expanded sectional view of the portion indicated by the section lines 4—4 in FIG. 1.

FIGS. 5 is an expanded cross-sectional view showing the orientation of bracket 33 and bracket clamp 37.

REFERENCE NUMERALS IN DRAWINGS

10: Linear Member
12: Sealing Flap
15: Line of Fusion
16: Upper Hole
17: Lower Hole
18: Union
20: Lip
21: Retaining Screw
22: Wing Edge
23: Retaining Arm
24: Wing
25: Retaining Screw Hole
26: Screw
27: Latch
28: Holes
29: Ledge
30: Frontal Surface
31: Release Button
32: Flange
33: Bracket
34: Mating Surface
35: Screw
36: Upper Slot
37: Bracket Clamp
38: Lower Slot
40: Frame
42: Screen
44: Boundary
48: Gap
49: Clamping Flange
51: Frame Insert
52: Frame Clamping Screw
54: Printing Press
56: Arched Surface.

DESCRIPTION OF THE PREFERRED EMBODIMENTS

Figure 1:
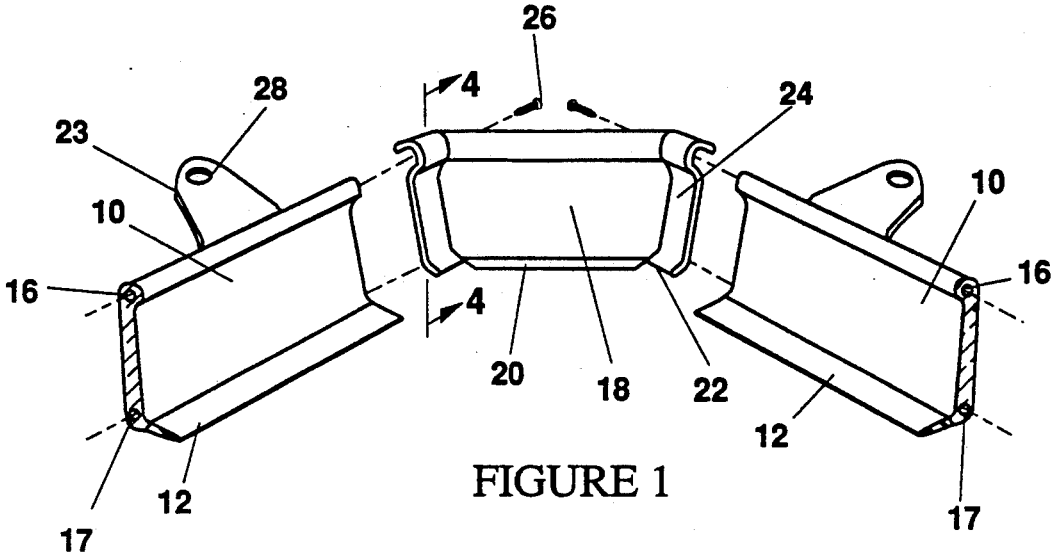
FIG. 1 is an exploded view showing the orientation of the elements of the invention in relation to each other.
Figure 2:
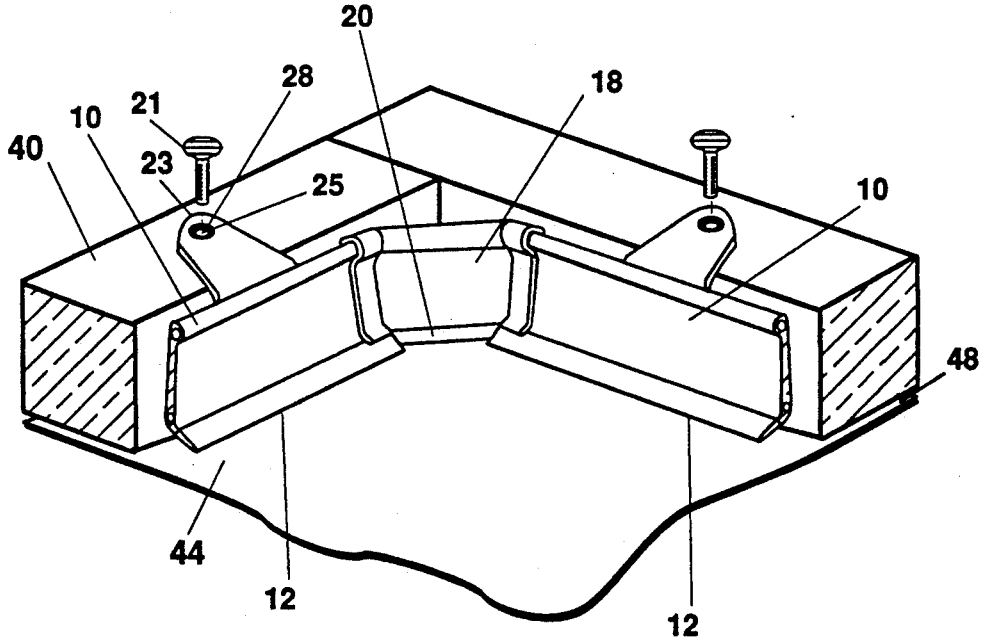
FIG. 2 is a perspective view showing retaining arms 23 incorporated into each linear member 10.

A preferred embodiment of the apparatus for containing viscous substances within the usable area of a screen printing frame assembly is shown in FIGS. 1 and 2. In this embodiment, linear members 10 are connected on end by a set of unions 18 thereby defining an enclosed area. Preferably, linear member 10 has sealing flap 12 affixed at its lower portion. The union 18 and linear member 10 preferably consist of a flexible thermal plastic material such as polypropylene while sealing flap 12 consists of a pliable thermal plastic rubber. In the embodiment shown, sealing flap 12 is a coextruded component of the profile comprising linear member 10. Sealing flap 12 is molecularly bonded to the linear member 10 during the coextrusion process. The molecular bond between sealing flap 12 and linear member 10 occurs at the line of fusion 15. Upper hole 16 and lower hole 17 are extruded channels into which screws 26, shown in FIG. 1, are threaded. To resist the harsh chemicals found in inks and cleaning solvents, sealing flap 12 is preferably constructed of Santoprene-brand TPR; Santoprene is a trademark of Monsanto Corp., Akron, Ohio. The apparatus is installed by placing it within frame 40, inserting retaining screws 21 through holes 28 in retaining arms 23, and fastening retaining screws 21 into retaining screw holes 25. In the preferred case, retaining arms 23 would be integral to the construction of linear members 10. However, retaining arms 23 could also be affixed to linear members 10 by use of mechanical fasteners such as threaded screws, by use of ultrasonic welding, heat staking, or other suitable method. FIG. 1 illustrates the typical structural configuration of such an apparatus. Linear member 10 interfaces with wing 24 at mating surface 34 (see FIG. 4). Screws 26 passing through upper slot 36 and lower slot 38 thread into upper hole 16 and lower hole 17 of linear member 10 securing it against flange 32. Sealing flap 12 interfaces and conforms to wing edge 22. Lip 20 protrudes outward and downward from frontal surface 30 of union 18. The ends of sealing flap 12 butt against the sides of lip 20.

An alternate retaining configuration similar to that shown in FIGS. 1 and 2 is shown in FIG. 3. The apparatus of this embodiment is differentiated in that retaining arms 23 are incorporated into unions 18 rather than linear members 10. In this embodiment, retaining screw holes 25 are located at the corners of frame 40 rather than along the sides. As shown, this configuration is suited well for roller-type frames since it is convenient to locate retaining screw holes 25 at the corners of a roller-type frame. This configuration is also advantageous for rectangular tube aluminum frames and wood frames mounted on presses where locating retaining arms 23 along the sides of the frame would interfere with the frame mounting mechanism of the screen printing press. For certain specific applications, it might be beneficial for retaining arms 23 to be located arbitrarily among unions 18 and linear members 10 as necessary to best secure the apparatus to a screen printing frame.

Figure 6:
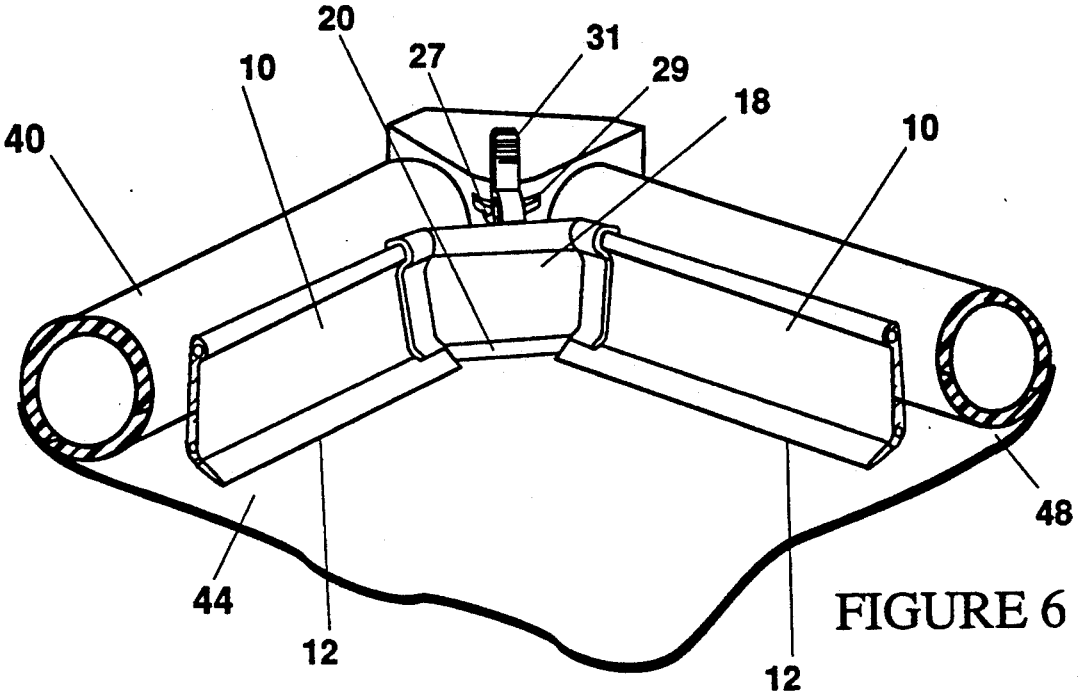
FIG. 6 is a perspective view showing a latching system jointly incorporated into unions 18 and frame 40.
Figure 7:
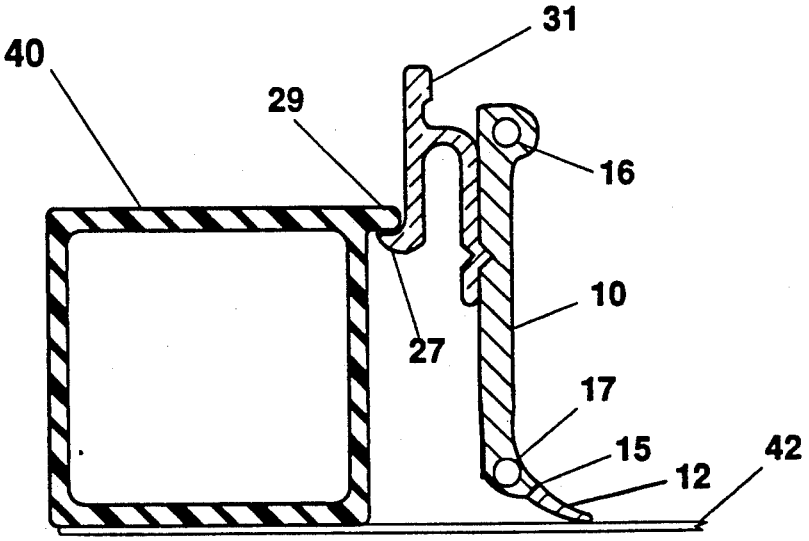
FIG. 7 is an expanded sectional view showing a latching system jointly incorporated into linear members 10 and frame 40.

Alternate mechanisms for retaining the apparatus to a screen printing frame are shown in FIGS. 5, 6, and 7. The retaining mechanism of FIG. 5 employs brackets 33 and bracket clamps 37 to mount the apparatus to frame 40. The apparatus is placed within frame 40, brackets 33 are inserted into bracket clamps 37 such that they engage the bottom surface of frame 40, and then, retaining screws 21 are fastened to secure brackets 33 of the apparatus. The apparatus according to this embodiment is advantageous in that it is inherently compatible with frame of different height (i.e. a roller frame with tube diameter of 2.00" and a roller frame with tube diameter of 1.50") FIGS. 6 and 7 illustrate a retaining mechanism utilizing latches 27 and ledges 29 to mount the apparatus to frame 40. In this embodiment, latches 27 are in combination with the apparatus and ledges 29 are in combination with frame 40. Installation is facilitated by placing the apparatus within frame 40 and engaging each latch 27 with the corresponding ledge 29. In the case of a screen printing frame fabricated with extruded sides, ledge 29 would preferably be integral to the extruded profile. The apparatus of FIG. 6 illustrates an embodiment in which latches 27 are incorporated into unions 18 and ledges 29 are correspondingly incorporated into the corner members of frame 40. FIG. 7 shows an embodiment in which latches 27 are incorporated into linear members 10 and ledges 29 are incorporated into the side walls of frame 40. Latch 27 of FIG. 7 is heat staked to linear member 10. Alternately, latch 27 could be affixed by mechanical fasteners such as threaded screws, by use of ultrasonic welding, or other suitable method. Also, the locations of latches 27 and ledges 29 could be reversed such that latches 27 are on frame 40 and ledges 29 are on the apparatus.

Figure 8:
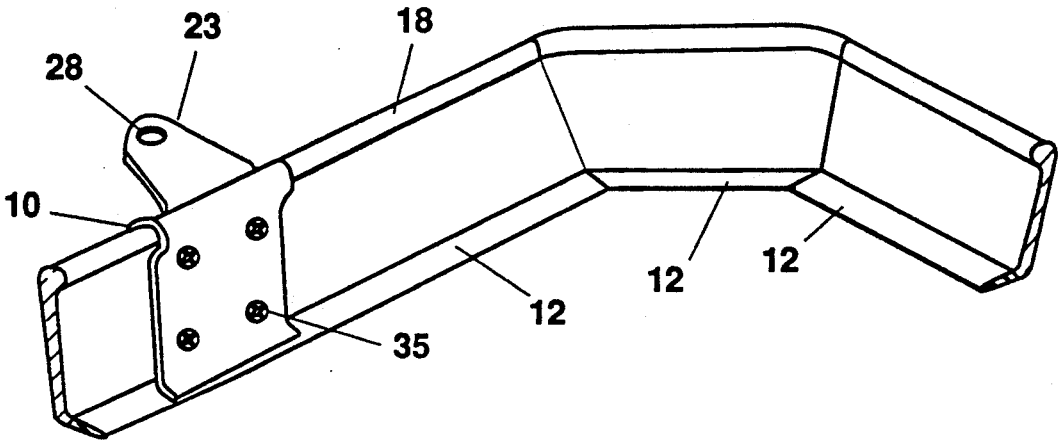
FIG. 8 is a perspective view showing an embodiment of the invention wherein a set of unions 18 encompass the entire perimeter of frame 40 and retaining arms 23 are incorporated into linear members 10.
Figure 9:
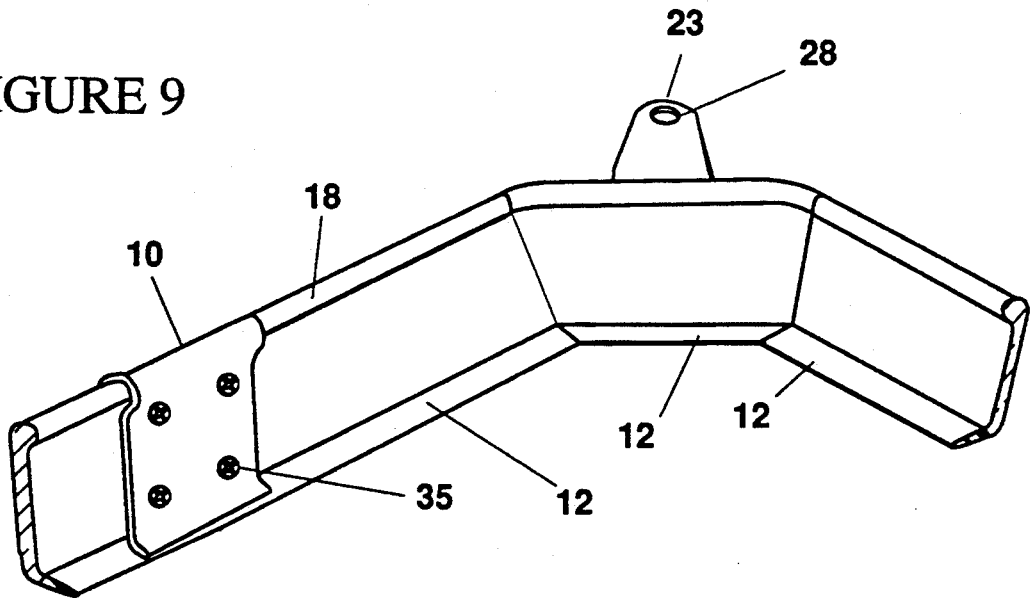
FIG. 9 is a perspective view showing an embodiment of the invention wherein a set of unions 18 encompass the entire perimeter of frame 40 and retaining arms 23 are incorporated into unions 18.

An alternate structural configuration in which a set of unions 18 encompass the entire perimeter of the screen printing frame is shown in FIGS. 8 and 9. Sealing flap 12 is attached to the lower portion of each union 18. In this embodiment, linear members 10 are substantially short and essentially join unions 18 together end to end. Screws 35 are used to secure linear members 10 to unions 18. The apparatus shown in FIG. 8 utilizes retaining arms 23 incorporated into linear members 10 to mount the apparatus to frame 40. As shown in FIG. 9, retaining arms 23 could be incorporated into unions 18 rather than linear members 10. For certain specific applications, it might be beneficial for retaining arms 23 to be located arbitrarily among unions 18 and linear members 10 as necessary to best secure the apparatus to a screen printing frame. Alternately, a latch-type retaining mechanism or a bracket and clamp type retaining mechanism could also be used.

Figure 10:
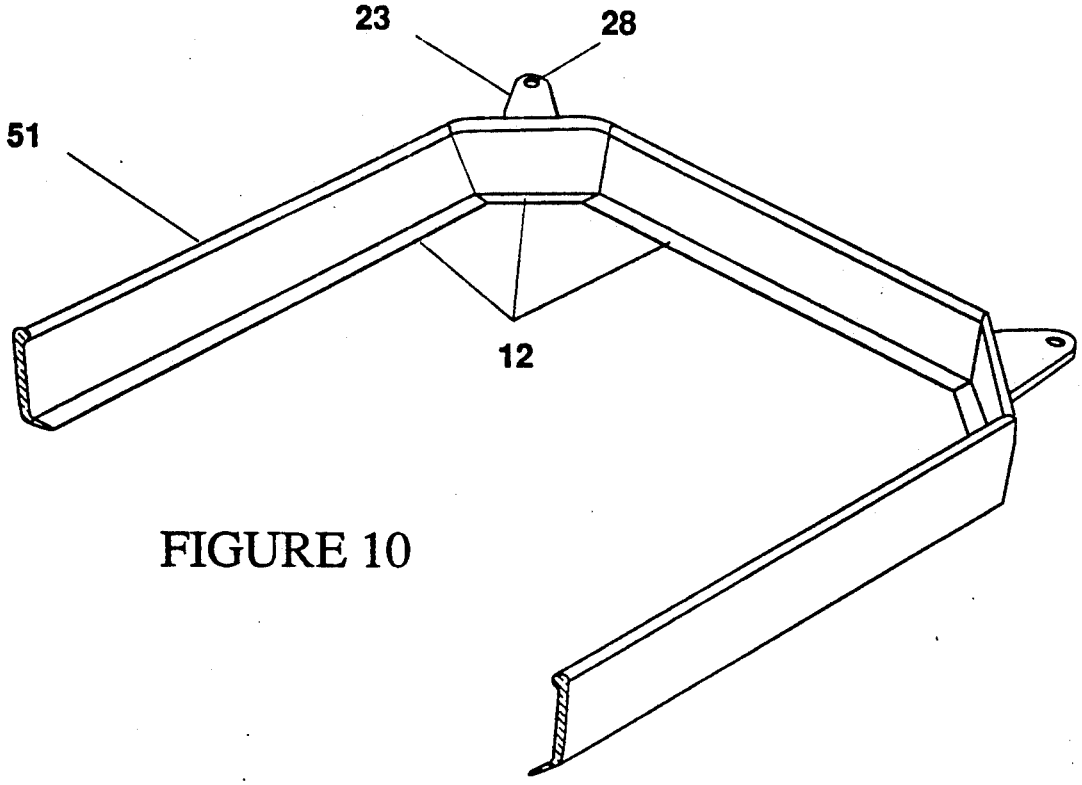
FIG. 10 is a perspective view showing an embodiment of the invention wherein the apparatus includes frame insert 51 which encompasses the entire perimeter of frame 40 and retaining arms 23 are incorporated into the corners of frame insert 51.
Figure 11:
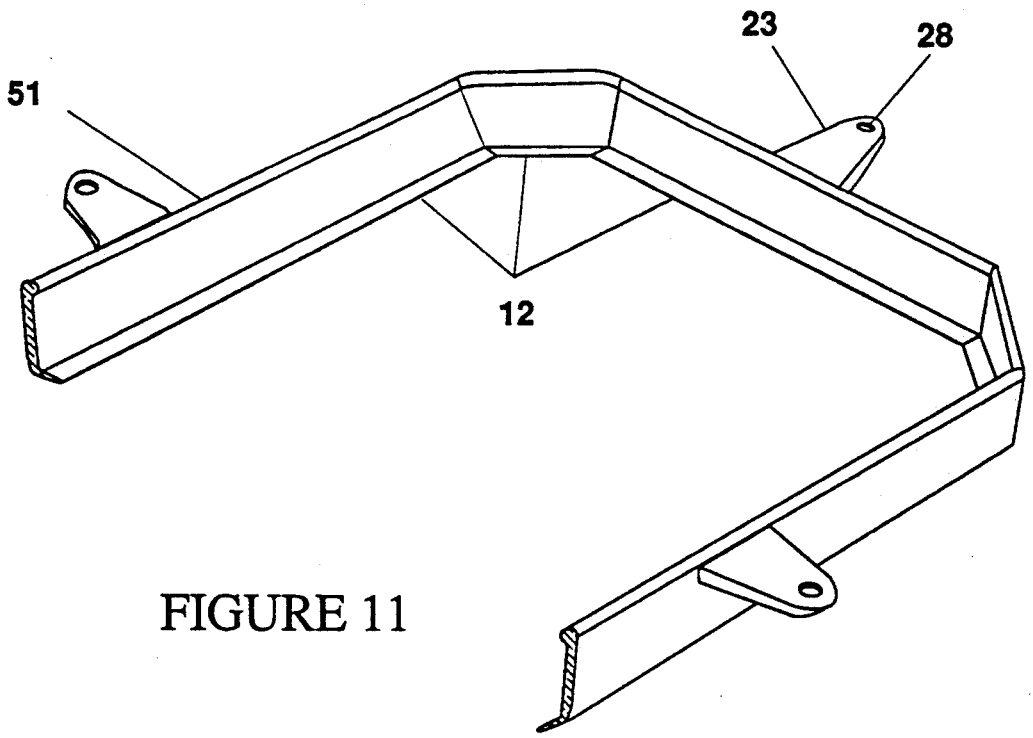
FIG. 11 is a perspective view showing an embodiment of the invention wherein the apparatus includes frame insert 51 which encompasses the entire perimeter of frame 40 and retaining arms 23 are incorporated into the sides of frame insert 51.

In the case where an apparatus consisting of a structural element of unitary construction were desired, an apparatus as shown in FIGS. 10 and 11 would be preferable. In this embodiment, linear members 10 and unions 18 are combined to form frame insert 51 which is of unitary construction. To provide the required sealing characteristics, sealing flap 12 encompasses the entire inside perimeter of frame insert 51. Retaining arms 23 are positioned at the corners of frame insert 51 (FIG. 10) or along the sides of frame insert 51 (FIG. 11). Alternately, a latch-type retaining mechanism or a bracket and clamp type retaining mechanism could also be used.

Figure 12:
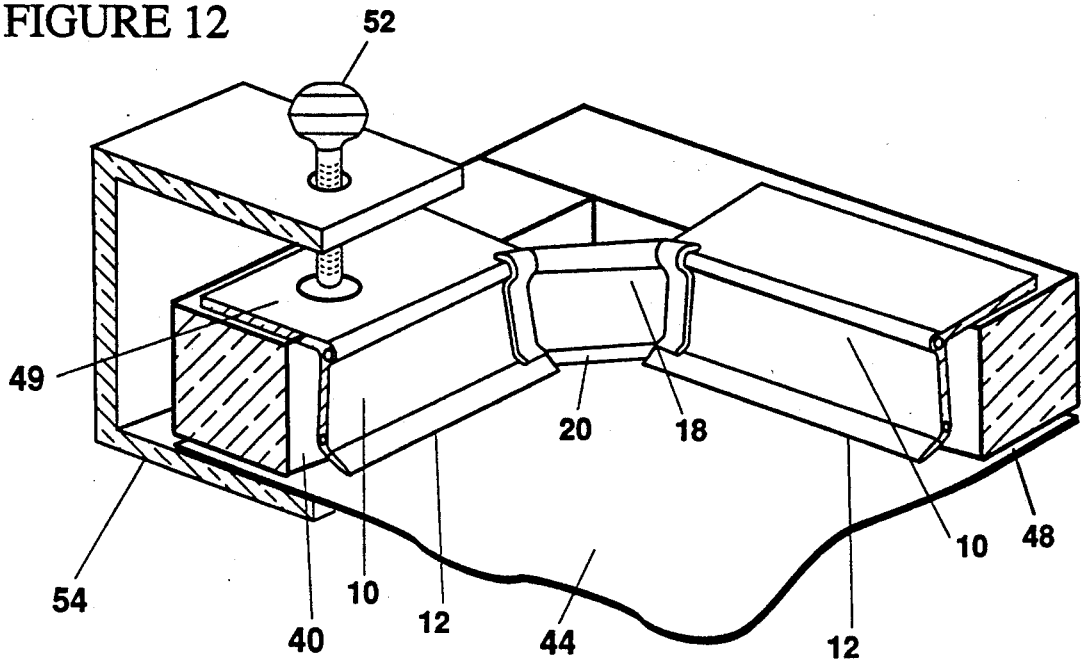
FIG. 12 is a perspective view showing an embodiment of the invention wherein the apparatus includes a set of linear members 10 and unions 18, and clamping flange 49 on each linear member 10.
Figure 13:
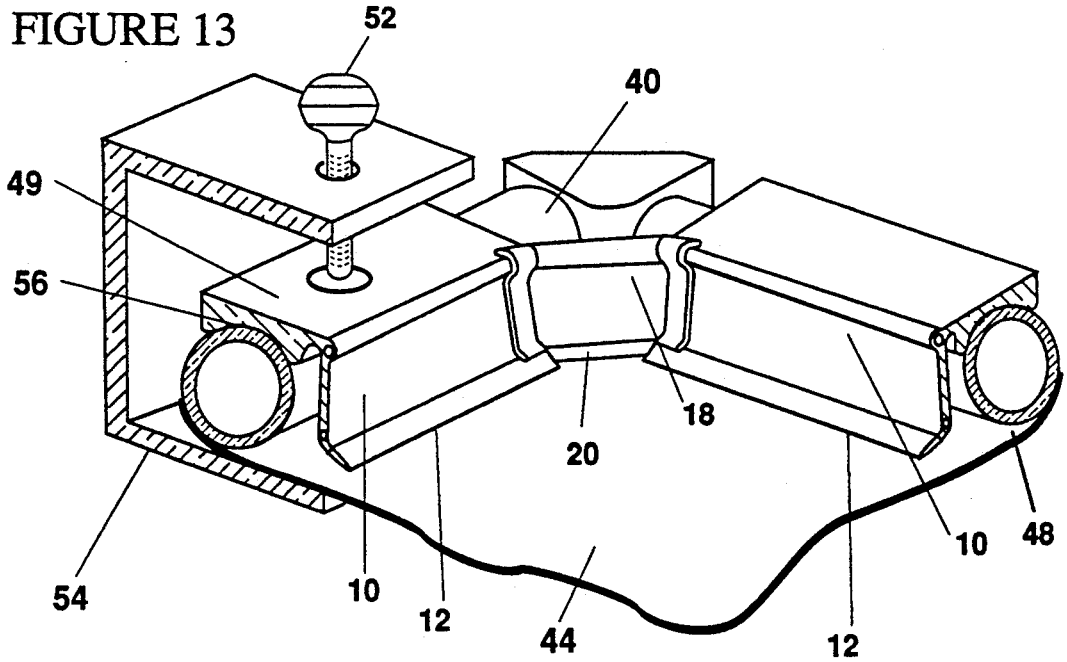
FIG. 13 is a perspective view showing a variation of the apparatus of FIG. 13 being used with a roller-type frame.

FIG. 12 shows an alternate mechanisms for retaining the apparatus to a screen printing frame which utilizes the frame mounting mechanism of printing press 54 to secure the apparatus to frame 40. Clamping flange 49 is provided along linear members 10 such that frame clamping screws 52 secure the apparatus to frame 40, and subsequently, frame 40 to printing press 54. Typically, a screen printing frame is mounted to the screen printing press via a clamping force applied to the top surface of the screen printing frame by a set of threaded fasteners or pneumatic/hydraulic rams. In the case of a round tube frame, adapters which are concave on one side and flat on the other are typically used to provide a flat surface on which the clamping force is applied. As shown in FIG. 13, these adapters can be readily incorporated into clamping flange 49 by including arched surface 56. Generally speaking, the force is applied at discrete points on the frame or distributed over a larger area using a flat plate. In either case, clamping flange 49 can be used to secure the apparatus to the screen printing frame while the frame is being secured to the printing press. Although not shown, this retaining method can similarly be used with an apparatus in which a set of unions 18 encompass the entire inside perimeter of the screen printing frame or with an apparatus in which a frame insert 51 is employed.

From the illustrative assemblies of substantially rigid retaining mechanisms presented above, alternate constructions will become apparent to those skilled in the art. For example, a set of hinges can be readily added to any of the substantially rigid retaining systems presented above such that the apparatus is hinged to the screen printing frame along one end of the screen printing frame and securely fastened to the screen printing frame at the other end or along the sides using one of the retaining methods presented above. Furthermore, it should also be readily apparent to one skilled in the art that the placement of the retaining mechanisms relative to the overall construction of the apparatus as shown in the drawings are for illustrative purposes only, and generally not a feature specific to the structure or operation of the invention.

Accordingly, the reader will recognize that the apparatus of this invention can be used to conveniently and reliably contain ink within the usable area of a screen printing frame assembly. In addition, the apparatus of this invention also provides the following advantages.

1. Environmentally safer than tapes because the apparatus of this invention is a durable product, designed for long-lasting use. Unlike tapes, this apparatus is non-disposable product that will be used as a tool rather than a disposable supply item. Therefore, the ecological hazards of throwing away ink covered tapes will not be experienced.

2. Less costly method of "taping-off" screens than using tapes since it is a durable, non-disposable product.

3. Less costly because the installation and removal time is a fraction of that required for tapes. Installation consists of simply placing the apparatus within the frame and fastening in place with the retaining mechanisms. Removal is facilitated by simply disengaging the retaining mechanisms and removing the apparatus. This also adds convenient since it can be installed quickly and easily before or after the frame is secured to the press.

4. Requires no maintenance other than an occasional cleaning when changing print colors or when excess ink build-up is experienced.

5. No special skills or training is required since the operation of the apparatus is relatively simple. The printers will be able to implement the apparatus into their current operation without any significant effort.

6. Less messy than tapes, since installing and removing the apparatus does not require the printer to come into contact with any ink that may be on it.

Although the description above contains many specifics, these should not be construed as limiting the scope of the invention, but as merely providing illustrations of some of the preferred embodiments of the invention at the time this application was drafted. For example, the apparatus can have other shapes such as triangular, trapezoidal, hexagonal, etc; the material of sealing flap 12 could be EPDM rubber and affixed to the main structure using ultrasonic welding; retaining arms 23 could mount to the outside face of frame 40 rather than the top surface as shown; latch 27es could be established by a combination of substantially mechanical components rather than a unitary flexural component as shown; etc.

Thus, the scope of the invention should be determined by the appended claims and their legal equivalents, rather than by the examples given.

I claim:

1. In combination, a screen and screen printing frame which contains a viscous substance within the utilizable area of said screen, and a structural assembly removeably received within and encompassed by said screen printing frame, said structural assembly comprising;

a plurality of linear members and a plurality of unions, said unions being fixedly coupled to the ends of said linear members, sealing means attached to said linear members and to said unions to encompass the entire perimeter of said structural assembly to inhibit the flow of the viscous substance between said structural assembly and said screen, and means enabling said structural assembly to be mounted in, maintained constant relative to, and removed from the screen printing frame as a unitary assembly, said enabling means including substantially rigid retaining means attached to the unions or the linear members or both the unions and linear members, said retaining means facing said screen printing frame.

2. The apparatus of claim 1, wherein said sealing means is comprised of a flexible sealing flap carried by each linear member on a surface thereof for providing sealing contact with an underlying screen surface, and a flexible sealing lip carried by each union on a surface thereof for providing sealing contact with an underlying screen surface.

3. The apparatus of claim 1, further including wing segments attached to each union, said wing segments extending inward of and parallel to each associated linear member thereby shielding the interfaces between the linear members and unions from contact with the viscous substance.

4. The apparatus of claim 1, wherein said retaining means includes latching means for mounting said structural assembly to said screen printing frame, said latching means including latches being affixed to the unions or the linear members or both the unions and linear members and ledges located on said screen printing frame, said latches releaseably engaging said ledges thereby securing said structural assembly to said screen printing frame.

5. The apparatus of claim 1, wherein said retaining means includes brackets and bracket clamps for mounting said structural assembly to said screen printing frame, said bracket clamps being affixed to the unions or the linear members or both the unions and linear members, said brackets releaseably engaging said screen printing frame, said bracket clamps releaseably securing said brackets to said structural assembly.

6. In combination, a screen and screen printing frame which contains a viscous substance within the utilizable area of said screen, and a structural assembly removeably received within and encompassed by said screen printing frame, said structural assembly comprising;

a plurality of linear members and a plurality of unions, said linear members being fixedly coupled to the ends of said unions, sealing means attached to said unions to encompass the entire perimeter of said structural assembly to inhibit the flow of the viscous substance between said structural assembly and said screen, and means enabling said structural assembly to be mounted in, maintained constant relative to, and removed from the screen printing frame as a unitary assembly, said enabling means including substantially rigid retaining means attached to the unions or the linear members or both the unions and the linear members, said retaining means facing said screen printing frame.

7. The apparatus of claim 6, wherein said sealing means is comprised of a flexible sealing flap carried by each union on a surface thereof for providing sealing contact with an underlying screen surface.

8. The apparatus of claim 6, wherein said retaining means includes latching means for mounting said structural assembly to said screen printing frame, said latching means including latches being affixed to the unions or the linear members or both the unions and linear members and ledges located on said screen printing frame, said latches releaseably engaging said ledges thereby securing said structural assembly to said screen printing frame.

9. The apparatus of claim 6, wherein said retaining means includes brackets and bracket clamps for mounting said structural assembly to said screen printing frame, said bracket clamps being affixed to the unions or the linear members or both the unions and linear members, said brackets releaseably engaging said screen printing frame, said bracket clamps releaseably securing said brackets to said structural assembly.

10. In combination, a screen and screen printing frame which contains a viscous substance within the utilizable area of said screen, and a structural assembly removeably received within and encompassed by said screen printing frame, said structural assembly comprising;

a frame insert, said frame insert being of unitary construction whereby it encompasses the entire inside perimeter of said screen printing frame, sealing means attached to said frame insert to encompass the entire perimeter of said structural assembly to inhibit the flow of the viscous substance between said structural assembly and said screen, and means enabling said structural assembly to be mounted in, maintained constant relative to, and removed from the screen printing frame as a unitary assembly, said enabling means including substantially rigid retaining means attached to said frame insert, said retaining means facing said screen printing frame.

11. The apparatus of claim 10, wherein said sealing means is comprised of a flexible sealing flap carried by said frame insert on a surface thereof for providing sealing contact with an underlying screen surface.

12. The apparatus of claim 10, wherein said retaining means includes latching means for mounting said structural assembly to said screen printing frame, said latching means including latches being affixed to said frame insert and ledges located on said screen printing frame, said latches releaseably engaging said ledges thereby securing said structural assembly to said screen printing frame.

13. The apparatus of claim 10, wherein said retaining means includes brackets and bracket clamps for mounting said structural assembly to said screen printing frame, said bracket clamps being affixed to said frame insert, said brackets releaseably engaging said screen printing frame, said bracket clamps releaseably securing said brackets to said structural assembly.

14. In combination, a screen printing press, a screen and screen printing frame which contains a viscous substance within the utilizable area of said screen, and a structural assembly removeably received within and encompassed by said screen printing frame, said screen printing press including a frame mounting device, said structural assembly comprising;

a plurality of linear members and a plurality of unions, said unions being fixedly coupled to the ends of said linear members, sealing means attached to said linear members and to said unions to encompass the entire perimeter of said structural assembly to inhibit the flow of the viscous substance between said structural assembly and said screen, and means enabling said structural assembly to be mounted in, maintained constant relative to, and removed from the screen printing frame as a unitary assembly, said enabling means including substantially rigid retaining means for mounting said structural assembly to said screen printing frame, said retaining means being affixed to the unions or the linear members, or both the unions and linear members, said retaining means facing said screen printing frame and being engaged by said frame mounting device.

15. The apparatus of claim 14, wherein said retaining means includes clamping flanges for mounting said structural assembly to said screen printing frame, said clamping flanges being affixed to the unions or the linear members or both the unions and linear members, said clamping flanges extending over the top surface of said screen printing frame whereby said structural assembly is releaseably secured to said screen printing frame by said frame mounting device, said frame mounting device applying clamping force on said clamping flanges thereby securing said structural assembly to said screen printing frame and said screen printing frame to said screen printing press.

16. In combination, a screen printing press, a screen and screen printing frame which contains a viscous substance within the utilizable area of said screen, and a structural assembly removeably received within and encompassed by said screen printing frame, said screen printing press including a frame mounting device, said structural assembly comprising;

a plurality of linear members and a plurality of unions, said linear members being fixedly coupled to the ends of said unions, sealing means attached to said unions to encompass the entire perimeter of said structural assembly to inhibit the flow of the viscous substance between said structural assembly and said screen, and means enabling said structural assembly to be mounted in, maintained constant relative to, and removed from the screen printing frame as a unitary assembly, said enabling means including substantially rigid retaining means for mounting said structural assembly to said screen printing frame, said retaining means being affixed to the unions or the linear members, or both the unions and linear members, said retaining means facing said screen printing frame and being engaged by said frame mounting device.

17. The apparatus of claim 16, wherein said retaining means includes clamping flanges for mounting said structural assembly to said screen printing frame, said clamping flanges being affixed to the unions or the linear members or both the unions and linear members, said clamping flanges extending over the top surface of said screen printing frame whereby said structural assembly is releasably secured to said screen printing frame by said frame mounting device, said frame mounting device applying clamping force on said clamping flanges thereby securing said structural assembly to said screen printing frame and said screen printing frame to said screen printing press.

18. In combination, a screen printing press, a screen and screen printing frame which contains a viscous substance within the utilizable area of said screen, and a structural assembly removeably received within and encompassed by said screen printing frame, said screen printing press including a frame mounting device, said structural assembly comprising;

a frame insert, said frame insert being of unitary construction whereby it encompasses the entire inside perimeter of said screen printing frame, sealing means attached to said frame insert to encompass the entire perimeter of said structural assembly to inhibit the flow of the viscous substance between said structural assembly and said screen, and means enabling said structural assembly to be mounted in, maintained constant relative to, and removed from the screen printing frame as a unitary assembly, said enabling means including substantially rigid retaining means for mounting said structural assembly to said screen printing frame, said retaining means being affixed to said frame insert, said retaining means facing said screen printing frame and being engaged by said frame mounting device.

19. The apparatus of claim 18, wherein said retaining means includes clamping flanges for mounting said structural assembly to said screen printing frame, said clamping flanges being affixed to said frame insert, said clamping flanges extending over the top surface of said screen printing frame whereby said structural assembly is releaseably secured to said screen printing frame by said frame mounting device, said frame mounting device applying clamping force on said clamping flanges thereby securing said structural assembly to said screen printing frame and said screen printing frame to said screen printing press.

* * * * *